US005308052A

United States Patent [19]

Roch et al.

[11] Patent Number: 5,308,052

[45] Date of Patent: May 3, 1994

[54] DEVICE FOR FEEDING A STACK OF FLAT ARTICLES ON EDGE TO DE-STACKER HEAD OF AN AUTOMATIC SORTING MACHINE AND A METHOD OF OPERATING THIS DEVICE

[75] Inventors: Olivier Roch, Valence; Louis Sabatier, Montelier; Jean-Marc Teluob, Valence, all of France

[73] Assignee: Compagnie Generale d'Automatisme CGA-HBS, Bretigny sur Orge, France

[21] Appl. No.: 34,472

[22] Filed: Mar. 19, 1993

[30] Foreign Application Priority Data

Mar. 27, 1992 [FR] France ..... 9203723

[51] Int. Cl.[5] ..... B65H 1/02

[52] U.S. Cl. ..... 271/2; 271/31.1; 271/105; 271/151

[58] Field of Search ..... 271/150, 151, 2, 31.1, 271/105

[56] References Cited

U.S. PATENT DOCUMENTS

| | | | |
|---|---|---|---|
| 2,847,213 | 8/1958 | Duncanson | 271/150 |
| 3,598,399 | 8/1971 | Cottrell | 271/149 X |
| 3,858,490 | 1/1975 | Heisler | 271/150 X |
| 5,118,249 | 6/1992 | Romagnoli | 271/150 X |
| 5,131,899 | 7/1992 | Nagahashi | 271/150 X |

FOREIGN PATENT DOCUMENTS

| | | |
|---|---|---|
| 0087341 | 8/1983 | European Pat. Off. . |
| 0416490 | 3/1991 | European Pat. Off. . |

*Primary Examiner*—Richard A. Schacher
*Attorney, Agent, or Firm*—Sughrue, Mion, Zinn, Macpeak & Seas

[57] ABSTRACT

The present invention concerns a device for feeding a stack of flat articles on edge, especially mail items, to a de-stacker head provided with a support surface, the device comprising a main feed magazine in which the stack is disposed and a plate pushing the rear of the stack. A secondary feed magazine is introduced between the main magazine and the support surface of the de-stacker head, the secondary magazine having an upwardly inclined transfer surface, its edge adjacent to the support surface of the de-stacker head being higher than the latter.

4 Claims, 2 Drawing Sheets

DEVICE FOR FEEDING A STACK OF FLAT ARTICLES ON EDGE TO DE-STACKER HEAD OF AN AUTOMATIC SORTING MACHINE AND A METHOD OF OPERATING THIS DEVICE

The present invention concerns a device for feeding a stack of flat articles on edge, especially articles of mail, to a de-stacker head provided with a support surface, the device comprising a main feed magazine in which the stack is disposed and a plate pushing the rear of the stack.

BACKGROUND OF THE INVENTION

In order to obtain good functioning of a de-stacker, it is essential that the feed device with which it is associated ensures proper presentation of the mail.

Several technical problems arise in the region of the de-stacker head.

Firstly, the incidence of damaged or torn articles should be minimized; in particular, the de-stacking of open mail in the nature of sheets folded into several flaps or small publicity or other brochures is especially subject to de-stacking problems, the conventional frictional anti-double-feed systems lead to creasing up or tearing of the mail items.

Secondly, the flow rate, i.e. the number of mail items treated per hour of operation should be maximized.

Thirdly, the incidence of multiple feeds occasioned by failure of mail items to separate should be minimized.

Fourthly, the dispersion in the frequency of injection into the sorting system should be optimized; more particularly, in the case of injection with spaces between mail items, it is necessary to take account of the repetition rate of the spaces between items (distance between trailing edge and leading edge) or the pitch (distance between leading edge and leading edge) and to respect a minimum spacing which is a value set by the performance of the sorting machine; in the case of injection with shingled items, it is necessary to take account of the repetition rate of the overlap value.

Moreover the known feeding devices are either of small capacity or compartmented, which makes loading the mail difficult and leads to a long loading time and thus to reduction in efficiency.

OBJECTS AND SUMMARY OF THE INVENTION

The present invention resolves these problems, regardless of the length of the stack of items to be handled, which can be very large and furthermore provides an ergonomic loading area for the mail items.

Moreover, it is possible by virtue of the invention to adjust the level of the main feed bed arbitrarily relative to the support surface of the de-stacking head; it is thus possible:

to have the main bed at a lower level than the said support surface;

to have the main bed at a higher level than the said support surface;

to have the main bed and the said support surface at the same level.

This is advantageous in particular when the device is fitted to an automatic sorting machine for preparing the postman's walk.

Thus, such a machine generally comprises a feed magazine or device in which the operator places the mail to be handled, a de-stacker whose role is to separate the mail items one by one and to feed them to a conveyor system, a read head associated with a microprocessor and facing the conveyor system so as to identify each item and assign it to a storage region corresponding to its final destination, and a series of storage regions (called stackers), each representing a predetermined sort destination.

For the postman's walk the sort is effected in three successive passes (explained in the Assignee's French patent application No. 90 12750). The operator thus has to replace the items twice in the feed device, keeping rigidly to a specific order. In order to facilitate this placement it is thus important that the stacker deck should be at the same level as the feed device. To realize such a sorting machine it is thus fundamental that the de-stacker support surface for the mail items should also be at the same level, in order to allow the articles to flow without an increasing fall in level.

In order to deal with these problems, in accordance with the invention, a secondary feed magazine is introduced between the main magazine and the support surface of the de-stacker head, the secondary magazine having an upwardly inclined transfer surface, its edge adjacent to the support surface of the de-stacker head being higher than the latter.

By virtue of the secondary magazine the performance of the machine is improved, because it ensures that the article to be taken off the stack will be correctly placed against the de-stacker member, so that the incidence of damaged mail items is low, as well as the incidence of the multiple feeds; and this at the right time, leading to a low dispersion and a flow optimized as a function of that of the de-stacker head.

These results are obtained because of the pre-separation function of the secondary magazine, which removes any compression of the articles which are, on the contrary, predisposed to allow correct presentation against the de-stacker member.

According to another characteristic of the invention, the edge of the secondary magazine adjacent to the main magazine is lower than the transfer surface of the latter.

The first limited drop of the mail items at the input to the secondary magazine, driven by its own motor drive, starts the pre-separation of the mail items and creates a first discontinuity, which allows separation and relief of packing of the articles. The length of the stack of mail items on the main bed means that this stack is the site of major adhesion and contact forces.

The second limited drop of the mail items at the output of the secondary magazine completes the pre-separation, which is facilitated by the small length of the stack which it transfers, the forces between mail items being further reduced.

In a preferred embodiment, the pre-de-stacking can be improved by at least one of the following characteristics:

at least one low pressure chamber is associated with the de-stacker head, adhering the first item of mail against itself;

the support surface of the de-stacker head is provided with roller means in continuous rotation, projecting across the whole said surface and rotating in this region of the secondary magazine towards the de-stacker head;

a blower jet is located above the de-stacker head and is directed towards the support surface thereof.

The functions and advantages of these features will appear from a reading of the following description of a preferred embodiment of the invention.

In order to control the movements of the articles in optimum manner, the plate and main and secondary magazines may be actuated independently on the basis of detectors.

The invention also concerns a method of operating the device fitted with such detectors.

More particularly, in this operation, two detectors located near to the de-stacker head control the degree of filling in this region and command the advance of mail items in the secondary and main magazines.

Moreover, two detectors located near to the downstream edge of the secondary magazine control the inclination of the mail items in this region and command the advance of the mail items simultaneously or alternatively in the secondary and main magazines.

BRIEF DESCRIPTION OF THE DRAWINGS

The functions and advantages of these features will appear from a reading of the following description.

The invention is illustrated by two Figures.

MORE DETAILED DESCRIPTION

Figure 1:
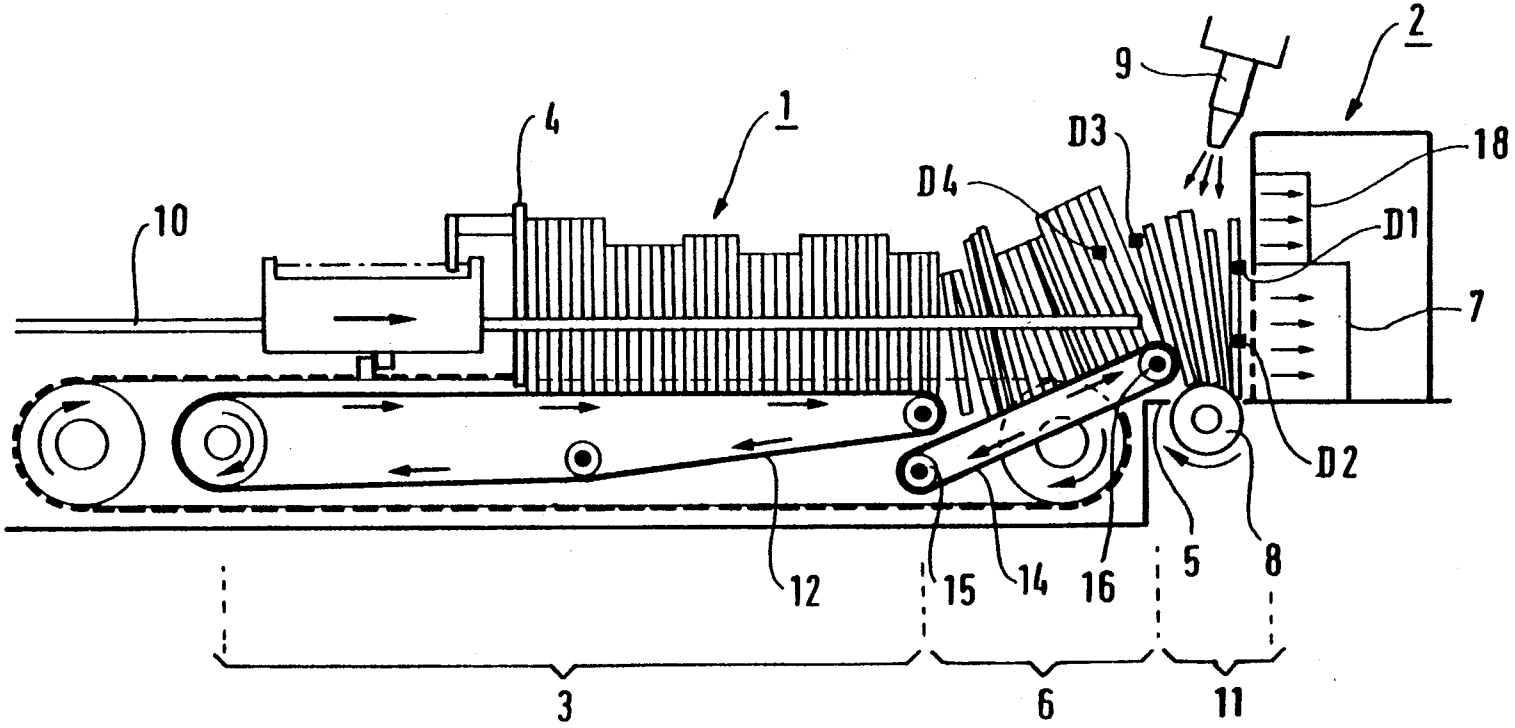
FIG. 1 shows a device in accordance with the invention in side view.
Figure 2:
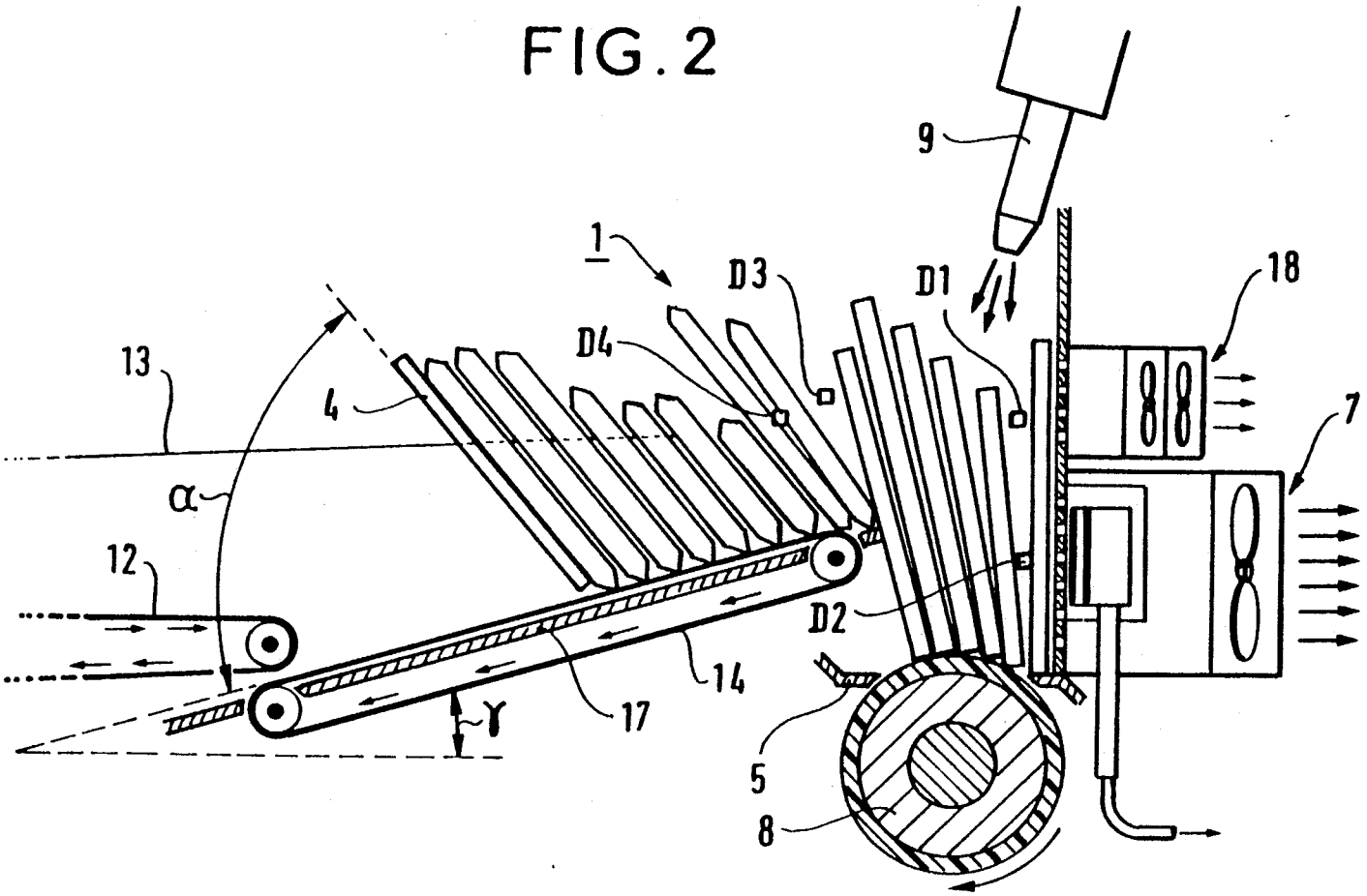
FIG. 2 is partial view of FIG. 1 to a larger scale.

The feed device comprises three sub-assemblies a main magazine 3, a secondary magazine 6, a so-called pre-de-stacker magazine 11.

The main magazine 3 is substantially horizontal and the stack of mail items 1 is placed on edge thereon, the sides of the mail items abutting against an alignment edge 13 common to the whole feed device. The rear of the stack is pushed towards a de-stacker head 2, located facing and downstream of the feed device, by a plate 4 mounted to slide on a substantially horizontal support rod 10 extending up to the downstream edge of the secondary magazine 6.

The main magazine 3 comprises a belt 12 covering the whole width of the magazine. The plate 4 and the belt 12 are operated at the same speed and motor driven though a clutch/brake CB2, not shown, for example through a motor-driven chain. This displacement is controlled by detectors D1 to D4, as will be seen below.

This arrangement of the main magazine has the following advantages; it gives an ergonomic loading region without compartments for filling by the operator and it provides a uniform contact surface with the belt, formed by a single belt only, which allows easy sliding and manipulation of the belt; moreover it has a large capacity and, by way of example, it may have a length around 4.35 meters, equivalent to around 3000 letters.

The secondary magazine 6 is interposed between the main magazine 3 and the pre-de-stacking magazine 11. It comprises a slide plate 17 inclined at an angle $\gamma$ which may be around 8° and three belts 14 in contact with the plate 17 and driven through shafts 15 and 16 by motor, not shown, fitted with a clutch/brake device CB1. The aligning plate 13 is the same as that provided for the main magazine 3.

The upstream edge of the secondary magazine 6 adjacent the main magazine 3 is located lower than the active surface of the latter, by around 30 mm for example. The edge adjacent to the pre-de-stacker magazine 11 is higher than the support surface 5 of the de-stacker head 2 in order to create a drop of the articles and is at a distance from the face of the de-stacker head 2 of some centimeters, in order to create the pre-de-stacker magazine 11. By way of example, the height of the drop may be around 55 mm and the distance between the edge of the plate 17 and the face of the de-stacker head around 50 mm.

By virtue of this design, the secondary magazine 6 ensures break-up of the stack of letters just upstream of the de-stacker head 2, forming a pack of mail items partially separated from the rest of the stack disposed in the main magazine 3, and ensuring a suitable presentation of the mail with a slight inclination of the items to the rear; thus this inclination before the de-stacking proper and during the feed phase of the pre-de-stacker magazine 11, avoids the letters flopping forward against the de-stacker head 2, which would lead to a larger number of multiple feeds with suppression of any pre-de-stacking; preservation of this inclination is ensured by control of the main magazine 3 and the secondary magazine by means of the detectors D3 and D4 and of the clutch/brakes CB1 and CB2 associated with the two magazines, as will be detailed later.

Another advantage of this design of the inclined secondary magazine 6 is that it is possible to obtain any desired configuration of the relative positions of the levels of the main magazine 3 and the support surface 5 (or the pre-de-stacker magazine 11), namely:

having the main bed and the said support surface at the same level, -having the main bed at a lower level than the said support surface, having the main bed at a higher level than the said support surface.

The pre-de-stacker magazine 11 comprises a support surface 5 for the de-stacker head, formed by a bottom plate for mail item and providing the de-stacking reference level. This plate is apertured to allow rollers 8 to project therethrough, these preferably being caused to rotate continuously during the de-stacking phase. They receive the mail items which drop from the secondary magazine 6, lightly urging the bottoms of the mail items against the face of the de-stacker head 2, which fans out the items of mail with openings facing upwards. By way of example, the rollers 8 can have a speed of 0.5 m/s, a diameter of 80 mm and project 5 to 6 mm above the plate 5.

The pre-de-stacker magazine further comprises a lower suction chamber 7 acting though the face of the de-stacker head 2. This suction is obtained from a fan with a high flow (for example in the order of 300 $m^3/h$) and a low degree of vacuum (for example 7 mbars), which allows the first mail item in the pre-de-stacker magazine to be adhered against a static region of the face of the de-stacker head 2.

This lower suction chamber 7 is complemented by an upper suction chamber 18 with a smaller flow and degree of vacuum, having the function of ensuring proper adhesion of large mail items (especially the first pages of catalogs) against the face of the de-stacker head 2.

The pre-de-stacker magazine 11 finally comprises an upper blower jet 9 (at a pressure in the order of 0.8 bar for example) located above the first mail items, by the face of the de-stacker head 2, with its jet directed to enhance the fanning out and completing the separation of the first item from the second item to be de-stacked.

When the first mail item has been de-stacked it leaves the face of the head 2 progressively, depending on its law of acceleration. When its rear edge clears the suction chamber 7, this will attract the following mail item with a force which increases progressively with the displacement of the mail item being taken off the stack and thus with the clearing of the suction chamber 7. After a certain time which is relatively short but which can vary in dependence on the size and weight of the mail items, the following mail item is in place against the face of the head 2, pre-separated from the rest of the pack and ready to be taken off the stack. This pre-separation feature takes place throughout the de-stacking.

The detectors D1 and D2 control the level of filling of the pre-de-stacker magazine and control its feed through the secondary magazine 6 if necessary, as will be seen below.

The method of operating the device will now be described.

Control over the main magazine 3 and over the secondary magazine 6 allow proper feed of the pre-de-stacker magazine 11. This control is effected by the detectors D1 to D4 and by the actuators CB1 and CB2 of the two magazines in question.

The detectors are D1 and D2 are photoelectric beam cells and control the filling level of the pre-de-stacker magazine 11. They are located at two different levels and near to the face of the de-stacker head 2.

The detectors D3 and D4 are likewise photoelectric beam cells and control the inclination of the mail at the downstream edge of the secondary magazine 6, before the mail items drop into the pre-de-stacker magazine 11. They are positioned slightly spaced in height near to this edge.

When the filling level of the pre-de-stacker magazine 11 is correct the cells D1 and D2 are obscured, the clutches C1 and C2 are inactive and the brakes B1 and B2 are active. There is then no advance of the secondary and main magazines 6 and 3.

When the filling level is not correct, the cells D1 and/or D2 are not obscured. In this case, feed of the mail items is commanded, accordingly advance of the magazines 11 and/or 6.

As to the inclination $\alpha$ of the mail items in the secondary magazine 6, three cases can arise:

1) Correct inclination of the mail items:

The cell D3 is not obscured and the cell D4 is obscured; the demand for mail items by the cell pair D1 and D2 leads to simultaneous advance of the secondary and main magazines 6 and 3 (and of the associated plate 4), i.e. the clutches C1 and C2 are active and the brakes B1 and B2 are inactive until the cells D1 and D2 are obscured.

2) Incorrect inclination, mail items too vertical.

The cell D3 is obscured and the cell D4 is obscured; the demand for mail items by the cell pair D1 and D2 leads to advance of only the interface magazine, i.e. the clutch C1 is active, the brake B1 is inactive, the clutch C2 is inactive and the brake B2 is active until the cells D1 and D2 are completely obscured; the number of advances of the secondary magazine only resulting from demand from the cell pair D1 and D2 is preferably limited to three; if on the following demand for mail items it is found that the mail is still too vertical for the fourth successive time (cells D3 and D4 obscured), simultaneous advance of the secondary and main magazines is commanded in order not to create a perturbation in the stack of mail in the region of the junction between the two magazines.

3) Incorrect inclination, mail items inclined to far to the rear:

The cell D3 is not obscured or is obscured and the cell D4 is not obscured; the demand for mail items by the cell pair D1 and D2 leads to simultaneous advance of the secondary and main magazines until the cells D1 and D2 are obscured, or only the secondary magazine is stopped, i.e. the clutch C1 is inactive, the brake B1 active, the clutch C2 active and the brake B2 inactive; the main magazine is then commanded for an interval of time (preferably equal to 200 ms, the linear speed of the mail in the secondary magazine being 90 mm/s and that of the mail and the plate of the main magazine being 70 mm/s).

We claim:

1. A device for supplying individual flat articles, said device comprising:

a) a first feed magazine (3) extending substantially horizontally between first upstream and downstream ends thereof, said first feed magazine receiving a stack of flat articles placed on edge thereon and including means for displacing the flat articles of the stack towards said first downstream end at a first feed speed;

b) a second feed magazine (6) downstream of said first feed magazine and extending obliquely upwardly between second upstream and downstream ends of said second feed magazine, said second feed magazine receiving a pack of flat articles placed on edge thereon, supplied by said first feed magazine, said pack being generally smaller than the stack of flat articles, said second feed magazine having means (14) for displacing the flat articles of the pack towards said second downstream end thereof at a second feed speed;

c) a third feed magazine (11) downstream of said second feed magazine and extending substantially horizontally between third upstream and downstream ends of said third feed magazine, said third feed magazine receiving flat articles disposed on edge thereon supplied by said second feed magazine, and wherein:

d) the downstream end of the first feed magazine is disposed above the upstream end of the second feed magazine to create a first drop of said flat articles and the upstream end of said third feed magazine is disposed below the downstream end of the second feed magazine to create a second drop of said flat articles for causing said flat articles disposed on the second, upwardly inclined feed magazine to be inclined rearwardly with respect to a vertical direction;

e) first sensor means for detecting the presence or absence of said flat articles on said third feed magazine and second sensor means for detecting an inclined presentation of said flat articles on said second upwardly inclined feed magazine;

f) said first and second sensor means being operatively connected to said first and second feed magazines for controlling independently the first and second feed speeds of said flat articles so as to maintain a correct filling level of said third feed magazine along with a correct rearwardly inclined presentation of said flat articles on said second feed magazine.

2. The device according to claim 1, wherein the first sensor means comprise two photoelectric detectors (D1,D2) vertically spaced apart near the downstream end of the third feed magazine, and the second sensor means comprise two photoelectric detectors (D3,D4)

horizontally spaced apart near the downstream end of said second feed magazine.

3. The device according to claim 1, wherein said third feed magazine is provided with continuous rotatable roller means (8) for displacing said flat articles from the upstream end to the downstream end of said third feed magazine.

4. The device according to claim 1, further comprising a blower jet (9) disposed above the third feed magazine and facing said third magazine for fanning out said flat articles placed thereon.

* * * * *